US007678342B1

(12) United States Patent
Xu et al.

(10) Patent No.: US 7,678,342 B1
(45) Date of Patent: Mar. 16, 2010

(54) RISER REACTOR FOR FLUIDIZED CATALYTIC CONVERSION

(75) Inventors: Youhao Xu, Beijing (CN); Bende Yu, Beijing (CN); Zhigang Zhang, Beijing (CN); Jun Long, Beijing (CN); Fukang Jiang, Beijing (CN)

(73) Assignees: China Petrochemical Corporation, Beijing (CN); Research Institute of Petroleum Processing, SINOPEC, Beijing (CN)

( * ) Notice: Subject to any disclaimer, the term of this patent is extended or adjusted under 35 U.S.C. 154(b) by 0 days.

(21) Appl. No.: 09/553,990

(22) Filed: Apr. 20, 2000

(30) Foreign Application Priority Data

Apr. 23, 1999 (CN) ..... 99 1 05903

(51) Int. Cl.
*B01J 8/24* (2006.01)

(52) U.S. Cl. ..... 422/139; 422/142; 422/145; 422/214

(58) Field of Classification Search ..... 422/139–147, 422/188–190, 211; 208/113, 106
See application file for complete search history.

(56) References Cited

U.S. PATENT DOCUMENTS 2,377,657 A * 6/1945 Watts ..... 208/161
2,963,421 A * 12/1960 Luckenbach ..... 208/150
3,246,960 A * 4/1966 Sharp et al. ..... 422/214
3,639,228 A * 2/1972 Carr et al. ..... 208/153
3,785,782 A * 1/1974 Cartmell ..... 422/144
4,070,159 A * 1/1978 Myers et al. ..... 422/147
4,090,948 A 5/1978 Schwarzenbek ..... 208/74
4,295,961 A * 10/1981 Fahrig et al. ..... 208/161
4,336,160 A * 6/1982 Dean et al. ..... 502/42
4,388,218 A * 6/1983 Rowe ..... 502/43
4,422,925 A * 12/1983 Williams et al. ..... 208/75
4,427,537 A 1/1984 Dean et al. ..... 208/120.01
4,434,044 A 2/1984 Busch et al.
4,434,049 A 2/1984 Dean et al. ..... 208/153
4,435,279 A 3/1984 Busch et al.
4,650,566 A 3/1987 Buyan et al. ..... 208/153
4,666,586 A * 5/1987 Farnsworth ..... 208/161

(Continued)

FOREIGN PATENT DOCUMENTS

CA 1 265 464 2/1990

(Continued)

OTHER PUBLICATIONS

Corella et al. Increase of the Gas Conversion in a Fluidized Bed by Enlarging the Cross Section of the Upper Zone of the Bed. Industrial & Engineering Chemistry Process Design and Development. 1983, 22, 329-334.*

(Continued)

*Primary Examiner*—Jennifer A Leung
(74) *Attorney, Agent, or Firm*—Scully, Scott, Murphy & Presser, P.C.

(57) ABSTRACT

A riser reactor for fluidized catalytic conversion process consists of a prelift zone, a first reaction zone, a second reaction zone with enlarged diameter, an outlet zone with reduced diameter along coaxial direction form bottom to top, and the end of the outlet zone connects to a horizontal tube. The reactor is used for adjusting different operating conditions to process single or plural feedstock in each different reaction zone for producing the desired product.

7 Claims, 1 Drawing Sheet

U.S. PATENT DOCUMENTS

| | | | | | |
|---|---|---|---|---|---|
| 4,681,743 | A | * | 7/1987 | Skraba | 422/140 |
| 4,693,808 | A | | 9/1987 | Dewitz | |
| 4,717,467 | A | | 1/1988 | Haddad et al. | 208/113 |
| 4,859,424 | A | * | 8/1989 | Cabrera | 422/144 |
| 4,869,807 | A | | 9/1989 | Krishna | 208/120.01 |
| 5,089,235 | A | | 2/1992 | Schwartz et al. | 422/144 |
| 5,104,517 | A | | 4/1992 | Lomas et al. | 208/113 |
| 5,139,748 | A | | 8/1992 | Lomas et al. | 422/140 |
| 5,154,818 | A | | 10/1992 | Harandi et al. | 208/74 |
| 5,167,795 | A | * | 12/1992 | Gartside | 208/67 |
| 5,196,172 | A | * | 3/1993 | Weinberg et al. | 422/144 |
| 5,308,474 | A | | 5/1994 | Cetinkaya | 208/113 |
| 5,318,691 | A | | 6/1994 | Muldowney | 208/113 |
| 6,495,028 | B1 | * | 12/2002 | Xu et al. | 208/69 |

FOREIGN PATENT DOCUMENTS

| | | | | |
|---|---|---|---|---|
| CN | 88101168 | | | 9/1988 |
| CN | 1013870 | B | | 9/1991 |
| EP | 63901 | A1 | * | 11/1982 |
| EP | 0 139 392 | A1 | | 5/1985 |
| EP | 0 139 392 | B1 | | 5/1985 |
| EP | 0 162 978 | A1 | | 12/1985 |
| EP | 171460 | A1 | * | 2/1986 |
| EP | 0 398 557 | A1 | | 11/1990 |
| EP | 0 546 739 | A2 | | 6/1993 |
| EP | 0 546 739 | A3 | | 6/1993 |
| EP | 0 546 739 | B1 | | 6/1993 |
| EP | 0 564 678 | A1 | | 10/1993 |
| EP | 0 564 678 | B1 | | 10/1993 |
| EP | 0 593 823 | A1 | | 4/1994 |
| EP | 0 593 823 | B1 | | 4/1994 |
| GB | 767312 | | | 1/1957 |
| GB | 859246 | | | 1/1961 |
| WO | WO-93/00674 | A1 | | 1/1993 |

OTHER PUBLICATIONS

European Office Action and Search Report mailed Sep. 11, 2003 for European Patent Application No. 00108031.6, five pages.

* cited by examiner

RISER REACTOR FOR FLUIDIZED CATALYTIC CONVERSION

BACKGROUND OF THE INVENTION

This invention relates to an apparatus for catalytic conversion of hydrocarbon in the absence of added hydrogen or the consumption of hydrogen. More particularly, the present invention relates to a riser reactor for fluidized catalytic conversion.

The earlier fluidized catalytic cracking (FCC) process utilized a dense fluidized bed reactor in which fluid velocity was only 0.6-0.8 m/s, i.e. the weight hourly space velocity was only 2~3, and the maximum fluid velocity was only 1.2 m/s, i.e. the weight hourly space velocity was only 5~8. Product quantity and quality were adversely affected in the reactor because of the backmixing in the dense fluidized bed reactor. With the use of the zeolite catalyst having high activity and selectivity, a riser reactor was adopted to reduce fluid backmixing, and consequently, to improve the yield and quality of the desired product.

A riser reactor has made a great progress over a dense fluidized bed reactor as to geometric structure and operating mode, which are mainly embodied in that the initial feed and catalyst contacting at the bottom of the riser and the recovery of hydrocarbons from spent catalyst at the top of the riser are improved, and that the temperature gradient in the cross section of the riser and backmixing in vertical section of the riser have been reduced.

Techniques in initial feed and catalyst contacting tend to improve nozzle functions and to enhance the efficiency of initial feed and catalyst contacting. Improvement in nozzle functions tends to reduce pressure drop, to homogenize dispersion, to minimize the diameter of liquid droplets and homogenize liquid droplets distribution, which are disclosed in U.S. Pat. No. 4,434,049, U.S. Pat. No. 4,427,537, Chinese Patent No. 8801168 and European Patent No. 546,739. Techniques to enhance the efficiency of initial feed and catalyst contacting are disclosed in U.S. Pat. No. 4,717,467, U.S. Pat. No. 5,318,691, U.S. Pat. No. 4,650,566, U.S. Pat. No. 4,869,807, U.S. Pat. No. 5,154,818 and U.S. Pat. No. 5,139,748.

Another hot spot of research and development is to suppress overcracking and thermal reaction at the top of a riser. There are two technique routes at present, one is to use a rapid gas-solid separation apparatus at the outlet of the riser, which is disclosed in European Patent No. 162,978, European Patent No. 139,392, European Patent No. 564,678, U.S. Pat. No. 5,104,517, and U.S. Pat. No. 5,308,474, and the other is to use a quenching method in the outlet of the riser, which is disclosed in U.S. Pat. No. 5,089,235 and European Patent No. 593,823.

However, a conventional riser reactor is still an iso-diameter riser reactor. Fluid linear velocity is generally from about 4 m/s to about 5 m/s at the bottom of the riser. With the proceeding of cracking reaction and the decreasing of average molecular weight of hydrocarbons, fluid linear velocity is accelerated to 15~18 m/s at the outlet of the riser. Fluid residence time is only 2~3 seconds and thus some beneficial secondary reactions for the quality of desired products are suppressed in a conventional riser reactor. Therefore, it is necessary to modify the conventional riser reactor so as to favor the proceeding of the some secondary reactions and thus to obtain the desired products.

An object of the present invention is to provide a novel riser reactor, which not only can suitably increase secondary reaction time, but also can process plural hydrocarbon feedstocks.

SUMMARY OF THE INVENTION

The riser reactor according to the present invention characterizes in that the riser reactor consists of a prelift zone, a first reaction zone, a second reaction zone with enlarged diameter, an outlet zone with reduced diameter along coaxial direction from bottom to top of the riser reactor, and a horizontal tube connected to the end of the outlet zone links a disengager.

DETAILED DESCRIPTION OF THE INVENTION

Figure 1:
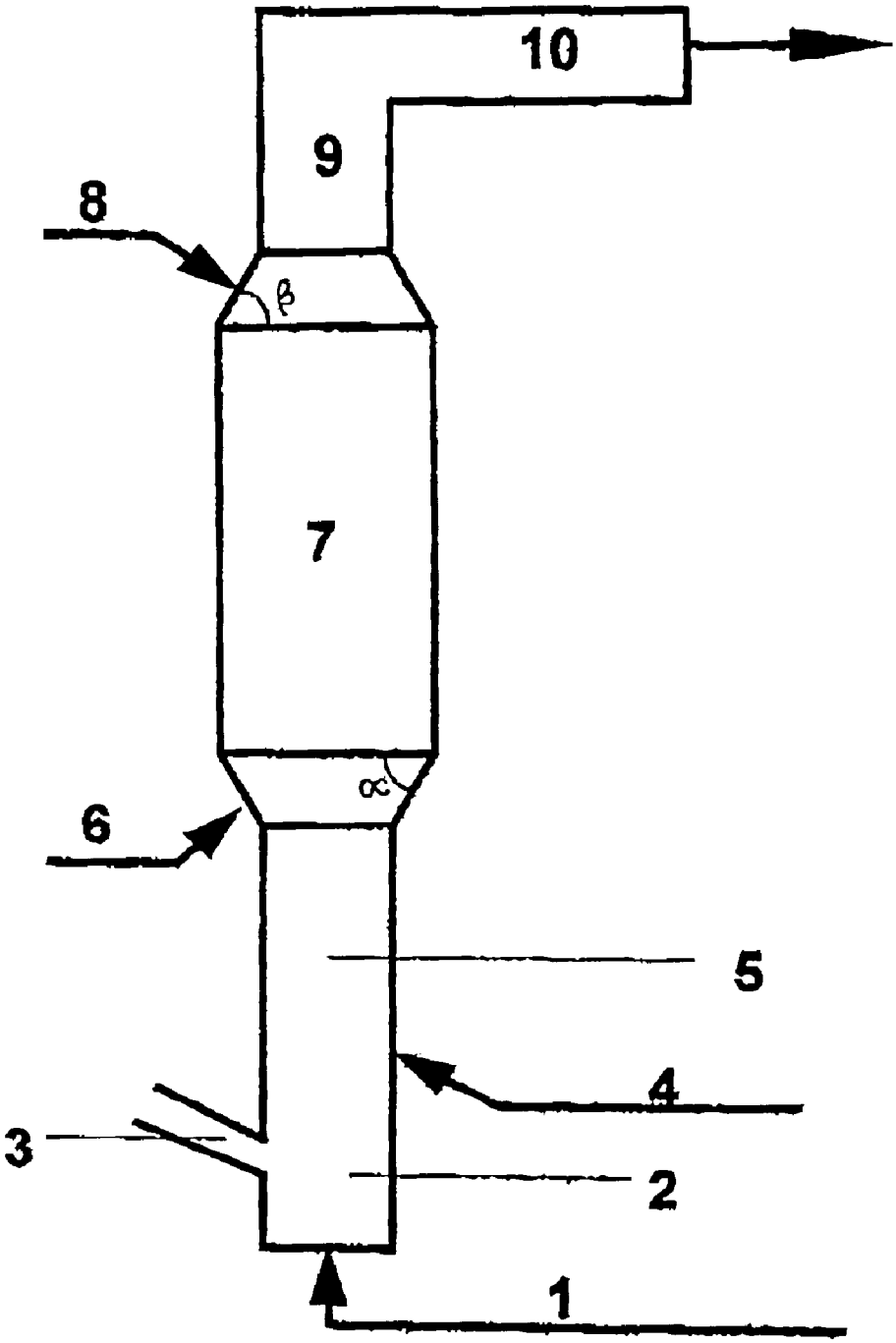
FIG. 1 attached herewith shows a schematic diagram of the riser reactor, including a prelift zone 2, a first reaction zone 5, a second reaction zone 7, an outlet zone 9, a horizontal tube 10, and conduits 1, 3, 4, 6 and 8.

The riser reactor consists of a prelift zone, a first reaction zone, a second reaction zone with enlarged diameter, an outlet zone with reduced diameter along coaxial direction from bottom to top of the riser reactor, and a horizontal tube connected to the end of the outlet zones links a disengager.

The total height of the prelift zone, the first reaction zone, the second reaction zone, the outlet zone of the riser reactor is generally from about 10 meters to about 60 meters.

The diameter of the prelift zone is the same as that of a conventional iso-diameter riser reactor and is generally from about 0.02 meter to about 5 meters. The height of the prelift zone is about 5%~10% of the height of the riser reactor. The function of the zone is to lift regenerated catalyst upward and to improve initial feed and catalyst contacting with the aid of a prelift medium selected from a steam or dry gas used in a conventional iso-diameter riser reactor.

The geometric structure of the first reaction zone of the riser is similar to that of the lower section of a conventional iso-diameter riser. Its diameter is equal to or greater than that of the prelift zone. The diameter ratio of the former to the latter is generally from about 1:1 to about 2:1. The height of the first reaction zone is about 10%~30% of the height of the riser reactor.

The conjunct (or junction) section between the first reaction zone and the second reaction zone is a circuit truncated cone whose vertical section isotrapezia vertex angle $\alpha$ is generally about 30°~80°.

The diameter of the second reaction zone is greater than that of the first reaction zone. The diameter ratio of the former to the latter is generally from about 1.5:1 to about 5:1. The height of the second reaction zone is about 30~60% of the height of the riser reactor.

The conjunct (or junction) section between the second reaction zone and the outlet zone whose vertical section isotrapezia base angle $\beta$ is generally about 45°~85°.

The structure of the outlet zone is similar to that of the outlet zone of a conventional iso-diameter riser. The diameter ratio of the outlet zone to the first reaction zone is generally about 0.8:1 to about 1.5:1. The height of this zone is generally about 0~20% of the height of the riser reactor. The function of this zone is to increase effluent velocity and to suppress overcracking and thermal reaction.

One end of the horizontal tube connects to the outlet zone and the other end links a disengager. When the height of the outlet zone is equal to zero, one end of the horizontal tube connects to the second reaction and the other end links a disengager. The diameter of the horizontal tube will be determined by those skilled in the art according to particular circumstances. The function of this zone is to link the outlet zone with a disengager for carrying the vapors and spent catalyst into a gas-solid separation system.

The inlet location of feedstocks, the inlet location of prelift mediums, the inlet location of regenerated catalyst, the atomized mode of feedstock and method of initial feed and catalyst contacting of the riser reactor are the same as those of a conventional iso-diameter riser reactor. The operating mode and operating conditions are similar to those of a conventional iso-diameter riser. The material required by the riser is the same as that required by a conventional iso-diameter riser.

When the riser reactor is used to process a kind of feedstock, operating conditions under the first reaction zone and the second reaction zone are adjusted respectively so that the reactions taking place in the first reaction zone are different from those in the second reaction zone, and thus producing the required product. For example, the feedstock is contacted with hot catalyst in the first reaction zone with the result that the primary cracking reaction takes place at higher reaction temperature, higher C/O ratio and shorter reaction time, in the second reaction zone having an extended diameter, vapors and catalyst with a decreasing velocity are mixed with quenching mediums and/or flow through a built-in heat exchanger. The zone temperature can be adjusted by quenching mediums and/or the heat exchanger. When the temperature of this zone must be maintained at lower temperature, a quenching medium can be introduced into the conjunct section between this zone and the first reaction zone and/or the heat remover is installed to remove part of heat of the zone so as to lower the reaction temperature of this zone and thus to suppress secondary cracking reaction and to increase isomerization and hydrogen transfer reaction, and thus the yield of LPG with higher isobutane content and the yield of gasoline with higher isoparaffin content are increased. When the temperature of this zone must be maintained at higher temperature, a quenching medium is charged into the conjunct section between the second reaction zone and the outlet zone and/or hot catalyst can be charged into the conjunct section between the first reaction zone and the second reaction zone and/or the heat supplier is set up in the zone, so as to suppress isomerization and hydrogen transfer reaction and increase secondary cracking reaction, and thus the yield of LPG with higher olefin content and the yield of gasoline with higher aromatic content are increased. As the term is used herein, the quenching medium is generally selected from the group consisting of quenching liquid, cooled regenerated catalyst, cooled semi-regenerated catalyst and fresh catalyst and the mixtures thereof in arbitrary ratio. Preferably, a quenching liquid is selected from the group consisting of LPG, gasoline, light cycle oil (LCO), heavy cycle oil (HCO) or water or the mixtures thereof in arbitrary ratio. When LPG and gasoline have high olefin content, they not only act as a quenching medium, but also participate in reaction. The cooled regenerated and semi-regenerated catalysts are obtained by cooling the regenerated catalyst or semi-regenerated catalyst through catalyst cooler. As the term is used herein, regenerated catalyst refers to catalyst having the residual carbon content of less than 0.1 wt %, and preferably less than 0.05 wt %, semi-regenerated catalyst having a residual carbon content of from about 0.1 wt % to about 0.9 wt %, and preferably from about 0.15 wt % to about 0.7 wt %.

Likewise, when the riser reactor according to the present invention is utilized to process split injection for a feedstock or different feedstocks, different reaction zones are used to process different feedstocks under different operating conditions for producing the desired product. For example, a heavier feedstock is charged into the bottom of the first reaction zone to conduct the primary cracking reaction in the first reaction zone, and then the reaction mixture flows into the second reaction zone and is mixed with the lighter feedstock which is charged into the conjunct section between the first reaction zone and the second reaction zone, to conduct some reactions, producing the desired product.

The riser reactor according to the present invention can be used to process feedstock including distillate having different boiling ranges, residue and crude.

More specifically, heavy hydrocarbon feedstock is selected from the group consisting of vacuum gas oil (VGO), atmosphere residue (AR) or vacuum residue (VR), coked gas oil (CGO), deasphalted oil (DAO), hydrotreated resides, hydrocracked resides, shale oil or the mixtures of thereof, light hydrocarbon feedstock is selected from the group consisting of, liquid petroleum gas (LPG), naptha, gasoline, atmospheric gas oils, catalytic gasoline, diesel, or the mixtures of thereof.

The riser reactor according to the present invention are adaptable for all known catalyst types including amorphous silica-alumina catalysts and zeolite catalysts with the active components preferably selected from the group consisting of Y, HY, USY or ZSM-5 series or any other zeolites typically employed in the cracking of hydrocarbons with or without rare earth and/or phosphor or the mixtures thereof.

The riser reactor according to the present invention are adaptable for the different type catalysts including large and small particle size distribution catalysts or high and low apparent bulk density catalysts with the active components preferably selected from the group consisting of Y, HY, USY or ZSM-5 series or any other zeolites typically employed in the cracking of hydrocarbons with or without rare earth and/or phosphor or the mixtures thereof. Large and small particle size distribution catalysts or high and low apparent bulk density catalysts flow into different reaction zones respectively. For example, the large particle size distribution catalyst with USY zeolite flows into the first reaction zone in order to increase cracking reaction, the small particle size distribution catalyst with ZSM-5 zeolites flows into the second reaction zone in order to increase aromatization reaction. The mixed large and small particle size distribution catalysts are stripped in a stripper and are combusted in a regenerator, and then are separated into large particle size distribution catalyst and small particle size distribution catalyst. The line of demarcation between large and small particle size distribution catalyst is in the range of 30~40 microns. The line of demarcation between high and low apparent bulk density catalyst is in the range of about 0.6~0.7 g/cm$^3$.

The riser reactor according to the present invention can be used for different processes, such as a process for producing isobutane and isoparaffin enriched gasoline, a process for producing propylene, isobutane and isoparaffin enriched gasoline, a process for producing light olefin and aromatic enriched gasoline, a process for producing maximum diesel yield, a process for producing ethylene and propylene, and a process for processing plural hydrocarbon feedstocks. The process conditions suitable for the riser reactor according to the present invention include that reaction temperature is preferably from about 400° C. to about 750° C., and even more preferably from about 450° C. to about 700° C., reaction time is preferably from about 2 seconds to about 30 seconds, and even more preferably from about 3 seconds to about 25 seconds. The weight ratio of catalyst to feed (hereinafter referred to as C/O ratio) is preferably from about 3:1 to about 40:1, and even more preferably from about 4:1 to about 35:1. The weight ratio of steam to feed (hereinafter referred to as S/O ratio) is preferably from about 0.03:1 to about 1:1, and even more preferably from about 0.05:1 to about 0.8:1, and reaction pressure is preferably about 130 kPa to 450 kPa in reaction zones.

The riser reactor according to the present invention has the following advantages:

1. The primary, secondary, overcracking and thermal reactions can be optimally controlled in the riser reactor to produce the higher yield and quality of the desired product.

2. The riser reactor is adaptable for processing different feedstocks under different reaction severity to obtain the higher yield and qualify of the desired product.

3. A conventional riser reactor is slightly revamped for practicing the present invention.

4. As compared with a conventional iso-diameter riser, the height of the riser is generally from about ½ to about ⅔ of that of a conventional iso-diameter riser under the same reaction time. Therefore, the height of the riser reactor can be lowered and the investment of the unit can be saved.

The following description of the riser reactor according to the present invention is more fully explained in the context of an attached drawing.

The riser reactor consists of a prelift zone 2, a first reaction zone 5, a second reaction zone 7 with enlarged diameter, an outlet zone 9 with reduced diameter along coaxial direction from bottom to top, and a horizontal tube 10 is connected to the end of the outlet zone joints.

A prelift medium is introduced into the prelift zone 2 via conduit 1. Hot regenerated catalyst flows into the prelift zone 2 via regenerated catalyst standpipe 3 and is lifted by prelift medium. The preheated feedstock mixed with dispersion steam is charged into the prelift zone via conduit 4, and then is contacted with hot regenerated catalyst, flowing into the first reaction zone 5 where cracking reaction takes place under certain reaction conditions. The effluent is mixed with a quenching medium or another reactant via conduit 6, flows into the second reaction zone where secondary reactions take place under certain reaction conditions. When the effluent in conduit 6 is a quenching medium, the function of the effluent is to reduce the temperature of this zone to benefit some secondary reactions. When the effluent from conduit 6 is another reactant, the function of the effluent is to participate in reaction and to reduce the temperature of this zone. A quenching medium is charged via conduit 8 into the conjunct section between the second reaction zone and the outlet zone, and then is mixed with the reacted mixtures, flowing into the outlet zone 9 and discharging from the horizontal tube 10. The function of the effluent via conduit 8 is to increase the second reaction temperature and to suppress overcracking and thermal reaction in the outlet zone.

EXAMPLES

The following examples are used to demonstrate the efficacy of the present invention and are not meant to limit the scope of the invention to the detailed examples shown herein. The properties of the feedstocks and catalysts used in practical examples and comparative examples are listed in table 1 and 2 respectively. The catalysts listed in table 2 are obtained from the catalyst complex of Qilu Petrochemical Corporation, SINOPEC.

Example 1

The example showed that hydrocarbon feedstock was converted to produce isobutane and isoparaffin enriched gasoline in a novel pilot plant riser reactor according to the present invention.

The height of the riser is 15 meters in which the height of the prelift zone with the diameter of 0.025 meter is 1.5 meters, the height of the first reaction zone with a diameter of 0.025 meter is 4 meters, the height of the second reaction zone with a diameter of 0.1 meter is 6.5 meters, the height of the outlet zone with a diameter of 0.025 meter is 3 meters. The isotrapezia vertex angle $\alpha$ of the vertical section of the conjunct section between the first reaction zone and the second reaction zone is about 45°. The isotrapezia base angle $\beta$ of the vertical section of the conjunct section between the second reaction zone and the outlet zone is about 60°.

The preheated hydrocarbon feedstock A listed in table 1 was charged into the riser reactor and contacted with hot regenerated catalyst A listed in table 2 in the presence of steam with the result that some reactions took place. The reaction products were separated into LPG with higher isobutane content, isoparaffin enriched gasoline and other products. Spent catalyst flowed into regenerator via stripping. After regeneration, regenerated catalyst was recycled for use.

Operating conditions and product slate were listed in table 3. Gasoline properties were listed table 4. Table 3 showed that 35.07 wt % of LPG was isobutane. Table 4 showed that the gasoline had an isoparaffin content of 36.0 wt %, and an olefin content of 28.11 wt %.

Comparative Example 1

Compared with example 1, the comparative example was practiced in a conventional pilot plant iso-diameter riser reactor.

Operating conditions and product slate were listed in table 3. Gasoline properties were listed in table 4. Table 3 showed that 15.74 wt % of LPG was isobutane. Table 4 showed that the gasoline had an isoparaffin content of 11.83 wt %, and an olefin content of 56.49 wt %.

Example 2

The example showed that hydrocarbon feedstock was converted to produce isobutane and isoparaffin enriched gasoline in accordance with the present invention when gasoline with high olefin content was used as a quenching medium.

The height of the riser is 15 meters in which the height of prelift zone with the diameter of 0.025 meter is 1.5 meters, the height of the first reaction zone with the diameter is 0.025 meter is 4 meters, the height of the second reaction zone with the diameter of 0.05 meter is 6.5 meters, the height of outlet zone with the diameter of 0.025 meter is 3 meters. The isotrapezia vertex angle $\alpha$ of the vertical section of the conjunct section between the first reaction zone and the second reaction zone is about 45°. The isotrapezia base angler, of the vertical section of the conjunct section between the second reaction zone and outlet zone is about 60°.

The feedstock and catalyst used in the example were the same as those in example 1. The gasoline produced in comparative example 1 as a quenching medium was charged into the conjunct section between the first reaction zone and the second reaction zone. The example was operated in the same manner as example 1.

Operating conditions and product slate were listed in table 5. Gasoline properties were listed table 6. Table 5 showed that 34.15 wt % of LPG was isobutane. Table 6 showed that the gasoline had an isoparaffin content of 43.86 wt %.

Example 3

The example showed that hydrocarbon feedstock was converted to produce isobutane and gasoline with higher isoparaffin content in accordance with the present invention when cooled regenerated catalyst was used as a quenching medium.

The height of the riser is 15 meters in which the height of prelift zone with the diameter of 0.025 meter is 1.5 meters, the height of the first reaction zone with a diameter is 0.025 meter is 4 meters, the height of the second reaction zone with a diameter of 0.05 meter is 6.5 meters, the height of outlet zone with a diameter is 0.025 meter is 3 meters. The isotrapezia vertex angle α of the vertical section of the conjunct section between the first reaction zone and the second reaction zone is about 45°. The isotrapezia base angle β of the vertical section of the conjunct section between the second reaction zone and outlet zone is about 60'.

The preheated hydrocarbon feedstock B listed in table 1 was charged into the first reaction zone and contacted with hot regenerated catalyst A listed in table 2 in the presence of steam, meanwhile the cooled regenerated catalyst via a catalyst cooler flowed into the second reaction zone and was mixed with the effluent from the first reaction zone. The reaction products were separated into LPG with higher isobutane content, gasoline with higher isoparaffin content and other products. Spent catalyst flowed into regenerator via stripping. After regeneration, regenerated catalyst was divided into two parts, one was recycled into the first reaction zone, and other part was cooled through a catalyst cooler and charged into the second reaction zone.

Operating conditions, product slate and gasoline properties were listed in table 7. Table 7 showed that LPG contained isobutane content of 34.97 wt %, whereas the content of butylenes is 17.49 wt %, and that the gasoline had an isoparaffin content of 41.83 wt %, and an olefin content of 15.17 wt %.

Example 4

The example showed that hydrocarbon feedstock was converted to produce light olefin, and that gasoline with high olefin was converted to produce gasoline with high aromatic content in accordance with the present invention.

The height of the riser is 15 meters in which the height of prelift zone with the diameter of 0.025 meter is 1.0 meters, the height of the first reaction zone with the diameter of 0.025 meter is 4.5 meters, the height of the second reaction zone with the diameter of 0.05 meter is 6.5 meters, the height of outlet zone with the diameter is 0.025 meter is 3 meters. The isotrapezia vertex angle α of the vertical section of the conjunct section between the first reaction zone and the second reaction zone is about 45°. The isotrapezia base angle β of the vertical section of the conjunct section between the second reaction zone and outlet zone is about 60°.

The preheated hydrocarbon feedstock B listed in table 1 was charged into the first reaction zone and contacted with hot regenerated catalyst B listed in table 2 in the presence of steam, meanwhile the gasoline with high olefin content produced in comparative example 1 as the feedstock was charged into the second reaction zone and was mixed with the effluent from the first reaction zone with the result that some reactions took place. The reaction products were separated into LPG with high light olefin content, aromatic enriched gasoline and other products. Spent catalyst flowed into regenerator via stripping. After regeneration, regenerated catalyst was recycled for use.

Operating conditions and product slate were listed in table 8. The reacted gasoline properties were listed table 9. Table 8 showed the yield of LPG was up to 38.35 wt %, in which propylene content is about 46.57 wt %, butylenes content is about 35.23 wt %. Table 9 showed that the gasoline had an aromatic content of 68.67 wt %.

Example 5

The example showed that diesel was produced in feedstock split injection in accordance with the present invention.

The height of the riser is 15 meters in which the height of prelift zone with a diameter of 0.025 meter is 1.5 meters, the height of the first reaction zone with a diameter of 0.025 meter is 4.5 meters, the height of the second reaction zone with a diameter of 0.05 meter is 9 meters. The isotrapezia vertex angle α of the vertical section of the conjunct section between the first reaction zone and the second reaction zone is about 45°.

Catalyst A was used in the example. The heavier vacuum residue having a density (20° C.) of 934.8 kg/m$^3$ and a carbon residue of 7.53 wt % was charged into the bottom of the first reaction zone. The lighter feedstock A whose properties is listed in table 1 was charged into the conjunct section between the first reaction zone and the second reaction zone.

Operating conditions and product slate were listed in table 10. Table 10 showed the yield of diesel was about 29.32 wt %.

TABLE 1

| Feedstock No. | A | B |
|---|---|---|
| Density(20° C.), kg/m$^3$ | 890.5 | 897.4 |
| Viscosity(100° C.), mm$^2$/s | 5.08 | 30.02 |
| Carbon Residue, wt % | 0.7 | 4.5 |
| Pour Point, ° C. | 40 | 47 |
| Nitrogen, wt % | 0.16 | 0.27 |
| Sulfur, wt % | 0.53 | 0.14 |
| Carbon, wt % | 85.00 | 86.26 |
| Hydrogen, wt % | 12.62 | 12.91 |
| Metal Content, ppm | | |
| Ni | 0.16 | 5.2 |
| V | 0.15 | <0.1 |
| Fe | — | 4.2 |
| Cu | — | <0.1 |
| Na | 0.45 | 5.5 |
| Distillation, ° C. | | |
| IBP | 278 | 324 |
| 10% | 385 | 408 |
| 30% | 442 | 486 |
| 50% | 499 | — |
| 70% | — | — |
| 90% | — | — |
| EP | — | — |

TABLE 2

| Catalyst Name | A | B |
|---|---|---|
| Trade Mark | ZCM-7 | CRP-1 |
| Chemical Composition, wt % | | |
| Aluminum oxide | 46.4 | 54.2 |
| Sodium oxide | 0.22 | 0.03 |
| Ferric oxide | 0.32 | |
| Apparent bulk density, kg/m$^3$ | 690 | 860 |
| Pore volume, mL/g | 0.38 | 0.26 |
| Surface area, m$^2$/g | 164 | 160 |
| Attrition index, wt %/hr$^{-1}$ | — | 1.2 |
| Particle size distribution, wt % | | |
| 0~40 microns | 4.8 | 26.0 |
| 40~80 microns | 47.9 | 60.8 |
| >80 microns | 47.3 | 13.2 |

TABLE 3

| Reactor | Example 1 The present invention | Comparative Example 1 Conventional riser |
|---|---|---|
| Reaction temperature, °C. | | 495 |
| The first reaction zone | 545 | — |
| The second reaction zone | 495 | — |
| Reaction time, second | 5.0 | 2.89 |
| The first reaction zone | 1.0 | — |
| The second reaction zone | 3.5 | — |
| The outlet zone | 0.5 | — |
| C/O ratio | 4.5 | 4.5 |
| S/O ratio | 0.05 | 0.05 |
| Product slate, wt % | | |
| Dry gas | 1.83 | 1.62 |
| LPG | 16.11 | 11.88 |
| In which isobutane | 5.65 | 1.87 |
| Gasoline | 46.86 | 41.59 |
| LCO | 23.44 | 22.81 |
| HCO | 7.77 | 18.76 |
| Coke | 3.88 | 2.86 |
| Loss | 0.11 | 0.48 |

TABLE 4

| Reactor | Example 1 The present invention | Comparative Example 1 Conventional riser |
|---|---|---|
| Density(20° C.), kg/m$^3$ | 743.6 | 749.8 |
| Octane Number | | |
| RON | 90.0 | 91.0 |
| MON | 79.0 | 79.8 |
| Induction period, min | >1000 | >485 |
| Existent Gum, mg/100 mL | 2.0 | 2.0 |
| Sulfur, wt % | 0.0095 | 0.0120 |
| Nitrogen, wt % | 0.0028 | 0.0033 |
| Carbon, wt % | 86.14 | 86.81 |
| Hydrogen, wt % | 13.72 | 13.12 |
| Distillation, ° C. | | |
| IBP | 46 | 50 |
| 10% | 73 | 77 |
| 30% | 95 | 99 |
| 50% | 114 | 122 |
| 70% | 143 | 145 |
| 90% | 171 | 175 |
| EP | 202 | 205 |
| Gasoline composition, wt % | | |
| Paraffins | 41.01 | 15.81 |
| In which Iso-paraffins | 36.00 | 11.83 |
| Naphthenes | 7.20 | 6.50 |
| Olefins | 28.11 | 56.49 |
| Aromatics | 23.68 | 21.20 |

TABLE 5

| Operating Conditions | |
|---|---|
| Reaction Temperature, ° C. | |
| The first reaction zone | 545 |
| The second reaction zone | 495 |
| Reaction Time, second | 5.3 |
| The first reaction zone | 0.8 |
| The second reaction zone | 3.9 |
| The outlet zone | 0.6 |
| C/O ratio | 5.0 |
| S/O ratio | 0.05 |

TABLE 5-continued

| Operating Conditions | |
|---|---|
| Product Slate, wt % | |
| Dry Gas | 1.78 |
| LPG | 17.51 |
| In which iso-butane | 5.98 |
| Gasoline | 47.98 |
| LCO | 22.30 |
| HCO | 6.22 |
| Coke | 4.00 |
| Loss | 0.21 |

TABLE 6

| | |
|---|---|
| Density(20° C.), kg/m$^3$ | 745.3 |
| Octane Number | |
| RON | 90.1 |
| MON | 80.9 |
| Induction Period, min | 800.0 |
| Existent Gum, mg/100 mL | 2.0 |
| Sulfur, wt % | 0.01 |
| Nitrogen, wt % | 0.003 |
| Carbon, wt % | 86.51 |
| Hydrogen, wt % | 13.42 |
| Distillation, ° C. | |
| IBP | 48 |
| 10% | 75 |
| 30% | 97 |
| 50% | 118 |
| 70% | 144 |
| 90% | 173 |
| EP | 203 |
| Gasoline Composition, wt % | |
| Paraffins | 47.87 |
| In which iso-Paraffins | 43.86 |
| Naphthenes | 7.45 |
| Olefins | 20.51 |
| Aromatics | 24.17 |

TABLE 7

| Operating Conditions | |
|---|---|
| Reaction Temperature, ° C. | |
| The first reaction zone | 550 |
| The second reaction zone | 500 |
| Reaction Time, second | 5.3 |
| The first reaction zone | 1.0 |
| The first reaction zone | 3.7 |
| The outlet zone | 0.6 |
| C/O ratio | |
| The first reaction zone | 5.0 |
| The second reaction zone | 6.5 |
| S/O ratio | 0.1 |
| Product Slate, wt % | |
| Dry Gas | 2.46 |
| LPG | 21.16 |
| In which Iso-butane | 7.40 |
| Butylene | 3.70 |
| Gasoline | 45.60 |
| LCO | 11.81 |
| HCO | 10.43 |
| Coke | 8.46 |
| Loss | 0.08 |
| Gasoline Properties | |
| RON | 90.3 |
| MON | 80.2 |

TABLE 7-continued

| Operating Conditions | |
|---|---|
| Aromatics, wt % | 31.20 |
| Olefins, wt % | 15.17 |
| Paraffins, wt % | 45.85 |
| In which n-paraffins, wt % | 4.02 |
| Iso-paraffins, wt % | 41.83 |
| Naphthenes, wt % | 7.78 |

TABLE 8

| Operating Conditions | |
|---|---|
| Reaction Temperature, ° C. | |
| The first reaction zone | 620 |
| The second reaction zone | 580 |
| Reaction Time, second | 7.3 |
| The first reaction zone | 1.5 |
| The second reaction zone | 5.0 |
| The outlet zone | 0.8 |
| C/O ratio | 10.0 |
| S/O ratio | 0.25 |
| Product Slate, wt % | |
| Dry Gas | 8.44 |
| LPG | 38.35 |
| In which ethylene | 3.76 |
| propylene | 17.86 |
| butylenes | 13.51 |
| Gasoline | 24.37 |
| LCO | 20.22 |
| Coke | 7.62 |
| Loss | 1.00 |

TABLE 9

| | |
|---|---|
| Density(20° C.), kg/m$^3$ | 816.6 |
| Octane Number | |
| RON | 100.0 |
| MON | 86.9 |
| Induction Period, min | 150 |
| Existent Gum, mg/100 mL | 2.4 |
| Sulfur, wt % | 0.0907 |
| Nitrogen, wt % | 0.0044 |
| Carbon, wt % | 88.85 |
| Hydrogen, wt % | 10.61 |
| Distillation, ° C. | |
| IBP | 58 |
| 10° | 100 |
| 30° | 120 |
| 50° | 137 |
| 70° | 144 |
| 90° | 161 |
| EP | 216 |
| Composition, wt % | |
| Paraffins | 5.80 |
| Olefins | 25.53 |
| Aromatics | 68.67 |

TABLE 10

| Operating Conditions | |
|---|---|
| Reaction Temperature, ° C. | |
| The first reaction zone | 550 |
| The second reaction zone | 480 |
| Reaction Time, second | 3.8 |

TABLE 10-continued

| Operating Conditions | |
|---|---|
| In which the first reaction zone | 0.8 |
| The second reaction zone | 3.0 |
| C/O ratio | 4.0 |
| S/O ratio | 0.05 |
| Product Slate, wt % | |
| Dry Gas | 1.83 |
| LPG | 9.70 |
| Gasoline | 35.47 |
| LCO (diesel) | 29.32 |
| HCO | 15.62 |
| Coke | 7.93 |
| Loss | 0.13 |

What is claimed is:

1. A riser reactor configured for a fluidized catalytic conversion process including hydrocarbon catalytic cracking reactions over said catalyst wherein the riser reactor has a riser reactor height of about 10 m to about 60 m and is configured to provide a total reaction time of 2 to 30 seconds, said riser reactor comprising a reactor bottom and further comprising in order from the reactor bottom:

a.) a prelift zone having a prelift zone diameter of about 0.02 m to about 5 m, and a prelift zone height that is about 5% to about 10% of the riser reactor height, said prelift zone having (i) a cracking catalyst inlet, and (ii) a prelift medium inlet, said prelift zone adapted to contain said cracking catalyst and adapted to lift said catalyst to a first reaction zone without cracking said feedstock in the prelift zone;

b.) a first reaction zone adapted to accept said cracking catalyst from said prelift zone and hydrocarbon feedstock to react said feedstock with said catalyst at a first reaction zone time to create first reacted vapor, and adapted to lift said catalyst, said unreacted feedstock, and said first reacted vapor to a second reaction zone, said first reaction zone having (i) a first reaction zone diameter, wherein the ratio of said first reaction zone diameter to said prelift zone diameter is about 1:1 to about 2:1, and (ii) a first reaction zone height that is about 10% to about 30% of the riser reactor height;

c.) a first conjunct section located between said first reaction zone and a second reaction zone, said first conjunct section in the form of a circular truncated cone whose vertical section isotrapezia vertex angle is about 30° to about 80°;

d.) a second reaction zone adapted to accept said cracking catalyst, unreacted hydrocarbon feedstock, and first reacted vapor from said first reaction zone, and adapted to react said unreacted hydrocarbon feedstock and said first reacted vapor with said catalyst for a second reaction zone time to create second reacted vapor, and adapted to lift said catalyst and said second reacted vapor to an outlet zone, said second reaction zone having (i) a second reaction zone diameter, wherein the ratio of said second reaction zone diameter to said first reaction zone diameter is about 1.5:1 to about 5:1; and (ii) a second zone reaction height that is about 30% to about 60% of the riser reactor height;

wherein said second reaction zone diameter and said second reaction zone height are configured to provide a second reaction zone time longer than said first reaction zone time; and e.) a second conjunct section located between said second reaction zone and an outlet zone, said second conjunct section in the form of a circular truncated cone whose vertical section isotrapezia base angle is about 45° to about 85°;

g.) an outlet zone adapted to accept said cracking catalyst and said second reacted vapor from said second reaction zone, and adapted to increase the velocity of effluent from said outlet zone to a disengager, said outlet zone having (i) an outlet zone diameter, wherein the ratio of said outlet zone diameter to said first reaction zone diameter is about 0.8:1 to about 1.5:1; and (ii) an outlet zone height that is up to about 20% of the riser reactor height.

2. The riser reactor of claim 1 further comprising:

(i) a horizontal tube connecting the outlet zone to said disengager.

3. The riser reactor of claim 1 wherein:

(i) the vertical section isotrapezia vertex angle of the first conjunct section is about 45°; and (ii) the vertical section isotrapezia base angle of the second conjunct section is about 60°.

4. The riser reactor of claim 1 wherein:

(i) the ratio of the first reaction zone diameter to the prelift zone diameter is 1:1; and (ii) the ratio of the second reaction zone diameter to the first reaction zone diameter is 2:1 to 4:1.

5. The riser reactor of claim 1 wherein said first conjunct section further comprises a catalyst inlet.

6. The riser reactor of claim 1 wherein said second conjunct section further comprises a quenching medium inlet.

7. The riser reactor of claim 1 wherein said riser reactor is configured to provide a total reaction time of 3 to 25 seconds.

* * * * *